United States Patent [19]

DeCoste, Jr.

[11] Patent Number: 4,907,696

[45] Date of Patent: Mar. 13, 1990

[54] COLLAPSIBLE CORE ADHESIVE ROLLS

[75] Inventor: Leonard D. DeCoste, Jr., Stoneham, Mass.

[73] Assignee: Kendall Company, Lexington, Mass.

[21] Appl. No.: 252,196

[22] Filed: Sep. 30, 1988

[51] Int. Cl.[4] ..... B65D 85/671; B65D 85/672

[52] U.S. Cl. ..... 206/411; 206/389; 428/343; 428/36.9

[58] Field of Search ..... 206/411, 389; 428/343

[56] References Cited

U.S. PATENT DOCUMENTS

| | | | |
|---|---|---|---|
| 401,233 | 4/1889 | Wheeler | 206/389 |
| 1,828,955 | 10/1931 | Bornmann | 206/389 |
| 1,880,950 | 10/1932 | Ewing et al. | 206/411 X |
| 2,303,144 | 11/1942 | Stephenson | 206/411 X |
| 3,737,360 | 6/1973 | Horn | 206/411 X |

*Primary Examiner*—George F. Lesmes
*Assistant Examiner*—D. R. Zirker
*Attorney, Agent, or Firm*—Alvin Isaacs

[57] ABSTRACT

Novel collapsible cores for adhesive tape rolls adapted to inhibit telescoping or migration of the adhesive tape off the roll after tape roll manufacture; and adhesive tape rolls prepared therefrom.

8 Claims, 1 Drawing Sheet

COLLAPSIBLE CORE ADHESIVE ROLLS

This invention relates to the art of manufacturing rolls of adhesive tape and, more particularly, to the core or hollow cylindrical member on which lengths of adhesive tape are traditionally wound.

Adhesive tapes are customarily prepared by forming a sheet or length of tape appreciably wider than the ultimate tape widths and then passing this tape through a slitting operation to provide a plurality of rolls of a given width, e.g. ¾", 1", 2", etc.

The tape may be formed by first applying an adhesive layer to the desired backing to form an elongated strip of adhesive-coated backing which may, for example, be on the order of 30–50 inches wide×70 or more yards long.

Following application of the adhesive layer, the resulting tape is generally wound on a master or jumbo roll and then transmitted in due course to the slitting operation.

There are basically two alternate ways of slitting to form a roll of tape of the desired width. In the first and most common procedure which may be referred to as "baloney slicing", the tape of the desired length is wound on a single core of the same width as the tape from the feed roll for the slitting operation and is then slit, as one envisions slicing baloney, into individual rolls of the desired width. Typically, this is done by passing the core on which the desired length of adhesive tape is wound through a slitting operation consisting of a plurality of slitting knives spaced apart to provide individual rolls of the desired width.

In the second or alternate method which from a manufacturing standpoint may be more desirable, the web of tape from the master (feed) roll is first slit to the desired width and then taken up on individual cores of the same width which are then ready for packaging and shipment.

In either case, a manufacturing problem referred to as "telescoping" occurs. [See FIG. 3 of the illustrative drawings.] In essence, telescoping is the fanning out of overlapping portions of the tape roll beyond the width of the core on which the tape is wound. Telescoped rolls will be rejected during quality control inspection in the manufacturing process, requiring either discarding or rewinding of the roll.

In the so-called baloney slicing method for tape manufacture, telescoping is not as severe a problem due to the fact that the narrow slit tape width is not elongated prior to winding it on a core.

The task of the present invention, simply stated, is to understand the cause of the problem known as telescoping and, once understood, to find a solution to the problem which is cost-effective and otherwise viable from a commercial manufacturing standpoint.

BRIEF DESCRIPTION OF THE INVENTION

In accordance with the present invention it has been determined that the cause of the problem is the stress recovery that the tape undergoes after slitting and winding on the core (as will be described in more detail hereinafter) and that the problem may be obviated by employing what is defined as a "collapsible core" so that the stress recovery phenomenon collapses the core rather than causing telescoping or sliding of the tape away from the core.

DETAILED DESCRIPTION OF THE INVENTION

As was previously alluded to, conventional methods of roll tape manufacture start with the coating operation at which an adhesive layer is applied to at least one side of a suitable backing material, e.g. by calendering, extrusion coating, casting, etc. to provide a long web of adhesive-coated backing. This web is taken up on rolls which then form the feed rolls for the slitting operation wherein the web is slit widthwise to provide tapes of the desired width, e.g. ¾", 1", 2", etc. The web is also cut to the desired length and wound on cores to provide the rolls of tape which are subsequently marketed.

In general, two alternate slitting processes are known, namely the "baloney slicing" technique and the shear slitting technique. In the former, tape of the desired length is wound on a core whose width approximately equals the width of the adhesive web. The resulting "elongated" roll of tape is then slit into a plurality of rolls of the desired width and then conveyed to the packaging and distribution stations. Slitting is customarily done in a single step by passing the roll of tape through a series of parallel slitting knives spaced apart to provide the desired widths.

In the shear slitting technique, the web is first slit to the desired width and length and taken up on individual cores for packaging and distribution.

In either case, the core members on which the tape is wound are continuous cylindrical cores made of a semi-rigid material such as cardboard, plastic, paper, laminates thereof, etc.

Irrespective of the slitting technique employed, the aforementioned problem of telescoping is a frequent occurrence, thereby adversely affecting manufacturing costs.

As was previously stated, the problem is not as severe in the baloney slicing procedure. However, it is a very serious problem in the aforementioned alternate slicing procedure. Accordingly, while this alternate procedure has certain manufacturing advantages which may render it more cost effective than baloney slicing, the telescoping problem may preclude its use in large scale industrial manufacture.

Figure 1:
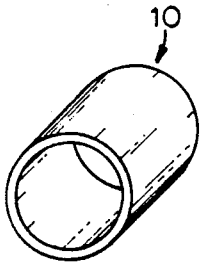
FIG. 1 is a perspective view of a conventional core for adhesive rolls according to the prior art.
Figure 2:
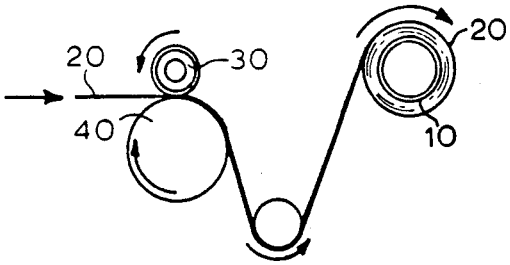
FIG. 2 is a schematic view illustrating the conventional slitting operation and tape roll formation.
Figure 3:
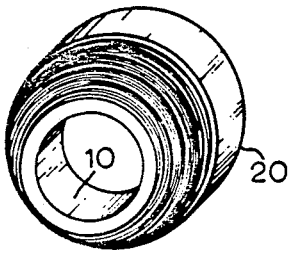
FIG. 3 is a perspective view of a roll of tape of the prior art illustrating the telescoping problem to which the present invention is directed.

The problem of telescoping, which, simply stated, is the task of this invention may best be understood by reference to FIGS. 1–3 of the accompanying drawing.

FIG. 2 illustrates schematically the shear slitting technique wherein a web of adhesive tape 20 from a master roll (not shown) is passed between a plurality of slitting knives and superposed rollers, only one of which knives 30 and rollers 40 are shown. The severed lengths of tape 20 are then wound on individual semi-rigid cores 10 which may be defined, for purposes of understanding the present invention, as being continuous or endless cylindrical bodies, as is best seen in FIG. 1.

In operation, the leading end of the tape web is wound onto the cores, and it is the drive action of the shaft on which the cores are placed which drives the web through the slitting knives 30.

This drive action pulling the tape web through the knives and superposed rollers produces a pulling action which creates tension which in turn creates a stress or stretching as the slit tape is wound onto the core.

Since the tapes are flexible to varying degrees, they possess an elastic memory. Accordingly, after being wound on their cores, they undergo stress recovery and it is this stress recovery which has been determined to cause the migration off the core, which migration is what is termed "telescoping", as seen in FIG. 3. The time in which telescoping occurs has been found to be directly proportional to the ambient temperature, so that increased ambient temperatures have been observed to initiate and/or accelerate roll telescoping.

Initial efforts to avoid roll telescoping, in accordance with this invention, were directed to lowering the tension or stress as the tape is pulled through the knives and wound on the core. However, at least some tension is inherent in the manufacturing process and even when minimal tension is used, roll telescoping was still observed. Accordingly, another means had to be found to obviate the telescoping problem.

In accordance with the present invention, the telescoping problem may be obviated or, at least, reduced materially to an acceptable occurrence level, by employing what may be described as a "collapsible core". If the core is collapsible, the stress recovery phenomenon will cause the core to collapse or deform rather than causing the tape to telescope or slide off the core.

Figure 4:
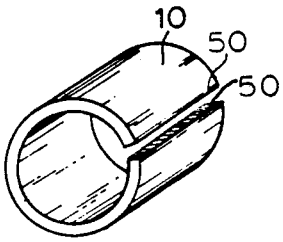
FIG. 4 is a perspective view of a collapsible core according to this invention.

The preferred method for providing a collapsible core in accordance with this invention is illustrated in FIG. 4. As shown therein, a thin section is removed along the length of the cylindrical core, providing two free ends 50, 50 in closed proximity but spaced apart in what then may be defined as a discontinuous cylindrical core. While the section removed is shown to be substantially perpendicular to the ends, it will be appreciated that removal of the section may also be made by cutting at an angle.

In general, the space provided between ends 50, 50 should be such that, upon stress recovery, the core collapses so that the ends are substantially abutting. If the space is too great, the respective ends will not meet and the modified (discontinuous) core will be noticeable. On the other hand, if too little is removed, some telescoping may still occur since the core does not collapse sufficiently to prevent the tape from migrating off the core.

The exact amount of space to be provided by severing a section of the core will at least in part be dependent upon the degree of stress relaxation of the tape and this will in part be dependent upon the elasticity of the particular tape and the degree of stress or stretching to which it has been subjected during manufacture. Accordingly, the space to be provided between ends 50, 50 of the discontinuous cores of this invention may vary somewhat from tape-to-tape and/or to the degree of tension applied. For this reason, it is not capable of precise numerical definition.

However, by way of illustration, with the commercially available tapes which Applicant has tested, a space of from about $\frac{1}{8}$ to about $\frac{1}{4}$ of an inch provides optimum results.

Figure 5:
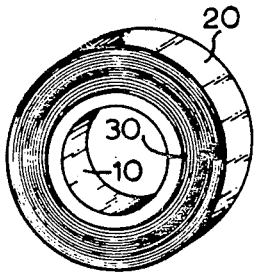
FIG. 5 is a perspective view illustrating a roll of tape prepared with a collapsible core of this invention.

FIG. 5 illustrates the aesthetic result desired if the core of FIG. 4 collapses to the proper degree. As shown, the edges of the tape are uniform with no telescoping and the free ends 50, 50 are substantially abutting so that the core is essentially cylindrical in configuration.

The core materials employed in the practice of this invention may in general be any of the semi-rigid materials heretofore employed in roll tape manufacture. Such materials will posses the rigidity and dimensional stability to retain their shape under the weight of the adhesive wound thereon but will have sufficient flexibility to collapse slightly under the stress relaxation heretofore described. Typically, such cores are made from cardboard or other paper-based laminates. In any event, the selection of particular core materials per se comprises no part of this invention and will accordingly be a matter of individual choice within the expected judgement of the skilled worker.

In like manner, for purposes of this invention, the adhesives and backings employed to prepare the tape are immaterial. Typically, they will comprise a pressure-sensitive adhesive, e.g. an acrylic or rubber-based adhesive comprising at least one natural or synthetic rubbery elastomer and one or more tackifying resin coated onto a polyolefinic, e.g. polyethylene, or other plastic sheet material. So-called two-faced tapes having an adhesive layer on each side of the backing are also contemplated, as are duct tapes and the like having a reinforcing cloth material disposed between the backing and the adhesive layer. While pressure-sensitive adhesive rolls are by far the most common, it will be appreciated that the invention is equally applicable to other types of adhesives, e.g. heat- or water activated adhesive tapes, as well. In general, typical tapes contemplated for use with the present invention may be characterized as comprising flexible polymer films with slow stress recovery.

It will also be appreciated that the width and length of the tapes is also immaterial. However, typically the rolls will be 0.75 to 2.5 inches wide and the lengths will range from about 15 to about 60 feet.

The following examples show by way of illustration and not be way of limitation the practice of this invention.

EXAMPLE

A slitting device as previously described having twelve slitting knives in parallel and spaced apart to provide $\frac{3}{4}$ inch tapes was employed in conjunction with $\frac{3}{4}$ inch cores in order to provide twelve $\frac{3}{4}$ inch tapes. The cores in the 2, 4, 6, 8, 10 and 12 positions were conventional continuous cardboard cores; while the cores in the 1, 3, 5, 7, 9 and 11 position on the drive shaft were discontinuous cores in accordance with this invention having a $\frac{1}{4}$ inch gap between the free ends of the cores. A web of commercially available butyl rubber-based pressure-sensitive adhesive on a plastic backing was employed to form twelve rolls of tape on the $\frac{3}{4}$ inch cores. The resulting tapes were measured to determine the maximum widths from one edge of the rolls to the other [In theory, the maximum widths should be approximately the $\frac{3}{4}$ inch of the tape and core.] Of the six continuous (control) cores, those in the 4, 8, 10 and 12 positions measured over 1.5 inches, indicating severe telescoping to over twice the core width. The continuous core in the two position telescoped appreciably less and the continuous core in the 6 or middle position unaccountably did not telescope at all. Of the six discontinous (experimental) tapes, the widths increased 0.07, 0.08, 0.07, 0.05, 0.06 and 0.03 inch, respectively, which from a commercial viewpoint were all fully acceptable rolls exhibiting no telescoping. In each instance with the tape wound on collapsible cores, the gap between the core ends did not close completely, leaving an average gap of 0.13 inch, thus indicating that a smaller gap could have been used. Even with this remaining thin gap, the roll is substantially cylindrical, aesthetically pleasing, and therefore acceptable.

Since certain changes may be made without departing from the scope of the invention herein involved, it is intended that all matter contained in the above description and the accompanying drawing shall be interpreted as illustrative and not in a limiting sense.

What is claimed:

1. An adhesive roll comprising an adhesive tape wound on a semi-rigid generally cylindrical core member of substantially the same width as said adhesive tape, said adhesive tape having been subjected to stress upon winding on said core member and stress recovery at some time thereafter, said core member being initially collapsible and having collapsed upon said stress recovery whereby to inhibit telescoping of said tape on said core member in which overlapping portions of said tape fan out beyond said core member.

2. An adhesive roll as defined in claim 1 wherein said adhesive tape comprises a pressure-sensitive adhesive.

3. An adhesive roll as defined in claim 2 wherein said pressure-sensitive adhesive comprises an acrylic or rubber-based adhesive coated on a plastic sheet material.

4. An adhesive roll as defined in claim 3 wherein said sheet material comprises a polyolefin.

5. An adhesive roll comprising an adhesive tape wound on a semi-rigid generally cylindrical core member of substantially the same width as said adhesive tape, said adhesive tape having been subjected to stress upon winding on said core member and stress recovery at some time thereafter, said core member being discontinuous characterized in that it has two free ends in spaced but closed proximity, said ends being collapsed as a function of said stress recovery of said tape so as to be substantially abutting, said collapse of said core member inhibiting telescoping of said adhesive tape.

6. An adhesive roll as defined in claim 5 wherein said space between said free ends is from about one-eighth to one-fourth of an inch.

7. An adhesive roll as defined in claim 6 wherein said adhesive tape comprises a pressure-sensitive adhesive coated onto a plastic backing material.

8. An adhesive roll as defined in claim 7 wherein said plastic backing comprises a polyolefinic material.

* * * * *